US008032981B2

(12) United States Patent
Yoo

(10) Patent No.: US 8,032,981 B2
(45) Date of Patent: Oct. 11, 2011

(54) VACUUM CLEANER

(75) Inventor: Dong-hun Yoo, Gwangju (KR)

(73) Assignee: Samsung Electronics Co., Ltd., Gwangju-si (KR)

( * ) Notice: Subject to any disclaimer, the term of this patent is extended or adjusted under 35 U.S.C. 154(b) by 714 days.

(21) Appl. No.: 12/150,217

(22) Filed: Apr. 25, 2008

(65) Prior Publication Data

US 2009/0144928 A1 Jun. 11, 2009

(30) Foreign Application Priority Data

Dec. 5, 2007 (KR) ..... 10-2007-0125720

(51) Int. Cl.
*A47L 5/00* (2006.01)

(52) U.S. Cl. ..... 15/331; 15/334; 15/335

(58) Field of Classification Search ..... 15/328, 15/329, 331–335; *A47L 5/00, 5/28, 5/24*
See application file for complete search history.

(56) References Cited

U.S. PATENT DOCUMENTS 6,058,559 A 5/2000 Yoshimi et al. ..... 15/328
7,555,810 B2 * 7/2009 Pullins et al. ..... 15/331

FOREIGN PATENT DOCUMENTS

JP 2005-040246 2/2005
JP 2005-095275 4/2005

OTHER PUBLICATIONS

British Combined Search and Examination Report dated Dec. 17, 2008 corresponding to Application No. GB0815232.4.

* cited by examiner

*Primary Examiner* — David Redding
(74) *Attorney, Agent, or Firm* — Ohlandt, Greeley, Ruggiero & Perle, LLP

(57) ABSTRACT

A vacuum cleaner includes a brush assembly that travels along a cleaning surface and draws in dirt-entrained air therethrough, a cleaner body that is connected to the brush assembly and has a dust collector, a fixing unit that detachably mounts the cleaner body onto the brush assembly such that the vacuum cleaner is used as an upright type vacuum cleaner and dismounts the cleaner body from the brush assembly such that the vacuum cleaner is used as a canister type vacuum cleaner, and a regulation unit that restricts a horizontal rotation of the brush assembly if the cleaner body is mounted onto the brush assembly.

18 Claims, 10 Drawing Sheets

VACUUM CLEANER

CROSS-REFERENCE TO RELATED APPLICATIONS

This application claims priority under 35 U.S.C. §119 from Korean Patent Application No. 10-2007-125720, filed on Dec. 5, 2007, in the Korean Intellectual Property Office, the entire disclosure of which is hereby incorporated by reference.

BACKGROUND OF THE INVENTION

1. Field of the Invention

Methods and apparatuses consistent with the present disclosure relate to a vacuum cleaner, and more particularly, to an upright type vacuum cleaner which can be operated as a canister type vacuum cleaner by detaching a cleaner body from an extension pipe assembly.

2. Description of the Related Art

Vacuum cleaners are generally classified as being either of a canister type, or an upright type.

The canister type vacuum cleaner includes a suction brush, an extension pipe, a flexible hose, and a cleaner body. The suction brush is mounted to the extension pipe which is connected to the cleaner body via the flexible hose. The canister type vacuum cleaner is suitable for the areas with doorsills and hard surfaces such as a wooden floor. The canister type vacuum cleaner is advantageous to clean a small area. However, the canister type vacuum cleaner causes a user an inconvenience when it is used to clean a large area because the user should drag it.

The upright type vacuum cleaner is used in the upright position and has a cleaner body disposed on an upper portion of a suction brush so that the suction brush and the cleaner body travel along with each other. Therefore, the suction brush has the dimensions sufficient to support the cleaner body. As the upright type vacuum cleaner has a bulky suction brush, a dust-scattering member such as an agitator could be easily embodied, and it can give a user a convenience when it is used to clean a large area or a carpeted surface. However, the upright type vacuum cleaner is not suitable for the area having doorsills and small areas.

As described above, the canister type vacuum cleaner and the upright type vacuum cleaner have conflicting disadvantages according to a condition of a cleaning surface. Recently, with the diverse needs of users, there has been a demand for a vacuum cleaner that is capable of complementing the disadvantages of the canister type vacuum cleaner and the upright type vacuum cleaner.

SUMMARY OF THE INVENTION

The present disclosure overcomes the above and other disadvantages.

An aspect of the present disclosure is to provide a vacuum cleaner that can be operated as an upright type vacuum cleaner or a canister type vacuum cleaner according to a condition of a cleaning surface.

The foregoing and/or other aspects and utilities of the present disclosure may be achieved by a vacuum cleaner including a brush assembly that travels along a cleaning surface and draws in dirt-entrained air therethrough, a cleaner body that is connected to the brush assembly and has a dust collector, a fixing unit that detachably mounts the cleaner body onto the brush assembly such that the vacuum cleaner is used as an upright type vacuum cleaner and dismounts the cleaner body from the brush assembly such that the vacuum cleaner is used as a canister type vacuum cleaner, and a regulation unit that restricts a horizontal rotation of the brush assembly if the cleaner body is mounted onto the brush assembly.

The brush assembly may include a suction brush, a connector that is connected to the suction brush and is rotated in a vertical direction, and an extension pipe assembly that is connected to the connector.

The extension pipe assembly may include a first extension pipe that is connected to the connector, a second extension pipe that has one end connected to the first extension pipe and the other end connected to the cleaner body via a flexible hose, the second extension pipe being inserted into the first extension pipe, an adjusting unit that adjusts lengths of the first and the second extension pipes, and a manipulation handle that is disposed on the second extension pipe.

The fixing unit may include a first locking member which supports a lower portion of the cleaner body, and a second locking member which supports an upper portion of the cleaner body and is locked and released by a user.

The first locking member may include a hook member that is integrally formed with the connector, and a hook receiving recess that is formed on a position of the cleaner body corresponding to the hook member.

The hook member may be L-shaped. The hook receiving recess may correspond to the hook member such that the hook member advances upwardly and is hooked into the hook receiving recess.

The second locking member may include a grip unit that is disposed on the first extension pipe, and a grip portion which is disposed on a position of the cleaner body corresponding to the grip unit.

The grip unit may include a support member that is fixed to a position of the first extension pipe to support a load applied from the cleaner body, a grip member that is hinged onto a position away from an upper portion of the support member, and an elastic member that is disposed between the support member and the grip member.

The grip member may include a push portion that is pushed by a user with his finger, a hook portion that is disposed opposite the push portion and selectively hooked onto the grip portion, and a support protrusion that supports one end of the elastic member.

The grip portion may include a first grip recess into which the support member is inserted, and a second grip recess into which the projection of the grip member is inserted.

The vacuum cleaner may further include a hose clamping device that clamps the flexible hose to a predetermined position.

The hose clamping device may include a first clamping unit that clamps the flexible hose at symmetric positions of the first extension pipe, and a second hose clamping unit that is disposed relatively lower than the first clamping unit.

The first hose clamping unit may include two clamp rings that are disposed at predetermined positions of the flexible hose and have hooking recesses, and hooking protrusions that are disposed on the first extension pipe and press-fitted into the hooking recesses.

The second hose clamping unit may have an opening that is disposed on the first extension pipe and has a radius corresponding to a diameter of the flexible hose to allow the flexible hose to be held therein.

The regulation unit may include a key hole which is formed penetratingly through the hook member, a fixing key that is ascendable and descendable in the key hole, an elastic member that elastically supports the fixing key, and a key recess that is disposed opposite the fixing key of the suction brush. If the cleaner body is mounted onto the brush assembly, the fixing key may be pressed by the cleaner body and thus may be inserted into the key recess, and if the cleaner body is dismounted from the brush assembly, the fixing key may be returned to an original position.

The suction brush may include an agitator that scatters dirt drawn in from a cleaning surface, and a driving unit that supplies a driving force to rotate the agitator.

The suction brush may have the agitator disposed at a front portion thereof and a traveling member disposed at a rear portion of the suction brush.

According to the present disclosure, it is possible to use the vacuum cleaner as an upright type vacuum cleaner by mounting the cleaner body onto the brush assembly or use the vacuum cleaner as a canister type vacuum cleaner by dismounting the cleaner body from the brush assembly according to a condition of a cleaning surface.

BRIEF DESCRIPTION OF THE DRAWINGS

Above and other aspects of the present disclosure will become apparent and more readily appreciated from the following description and the accompanying drawings in which.

DETAILED DESCRIPTION OF EXEMPLARY EMBODIMENTS

Figure 1:
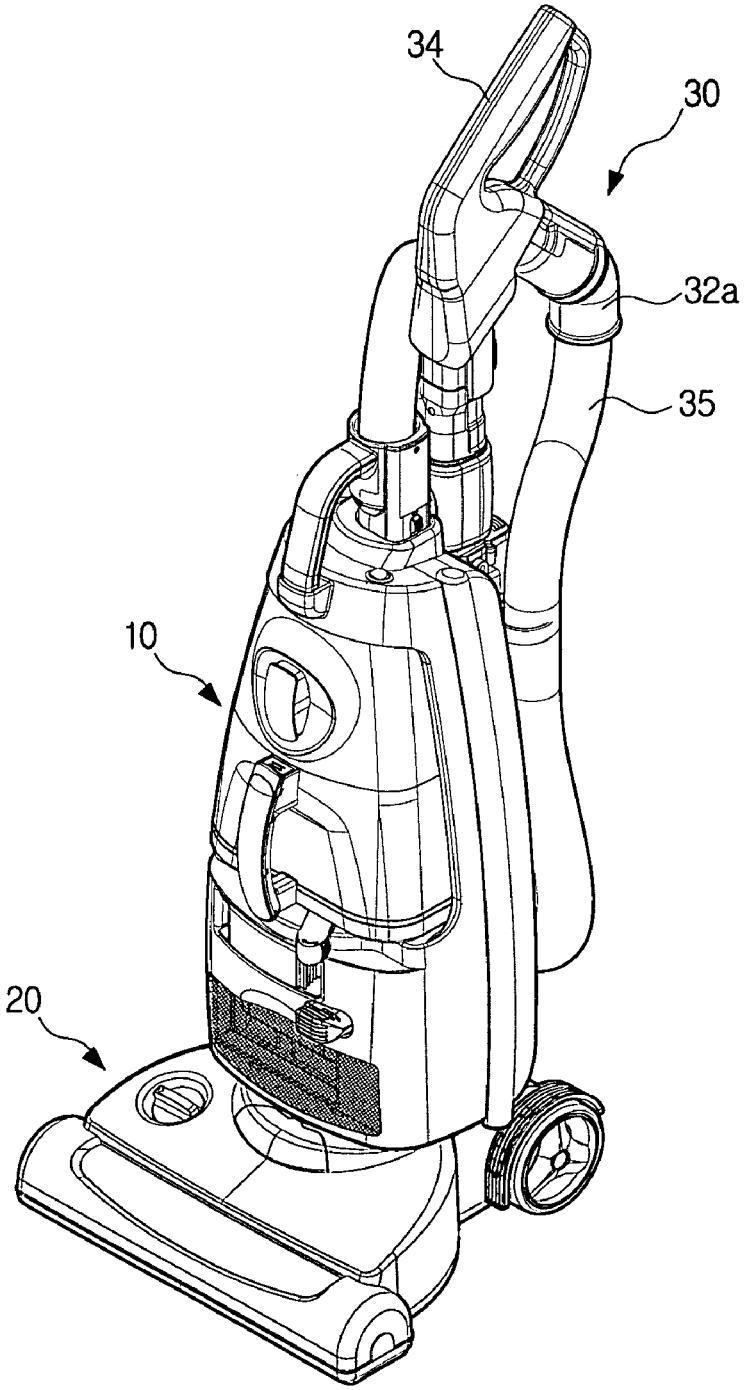
FIG. 1 is a perspective view illustrating a vacuum cleaner when it is operated as an upright type.

Certain exemplary embodiments of the present disclosure will be described in greater detail with reference to the accompanying drawings.

In the following description, the same drawing reference numerals are used for the same elements even in different drawings. The matter defined in the description, such as detailed construction and elements, are provided to assist in a comprehensive understanding of the invention. Thus, it is apparent that the exemplary embodiments of the present disclosure can be carried out without this specifically defined matter. Also, well-known functions or constructions are not described in detail since they would obscure the description with unnecessary detail.

Figure 10:
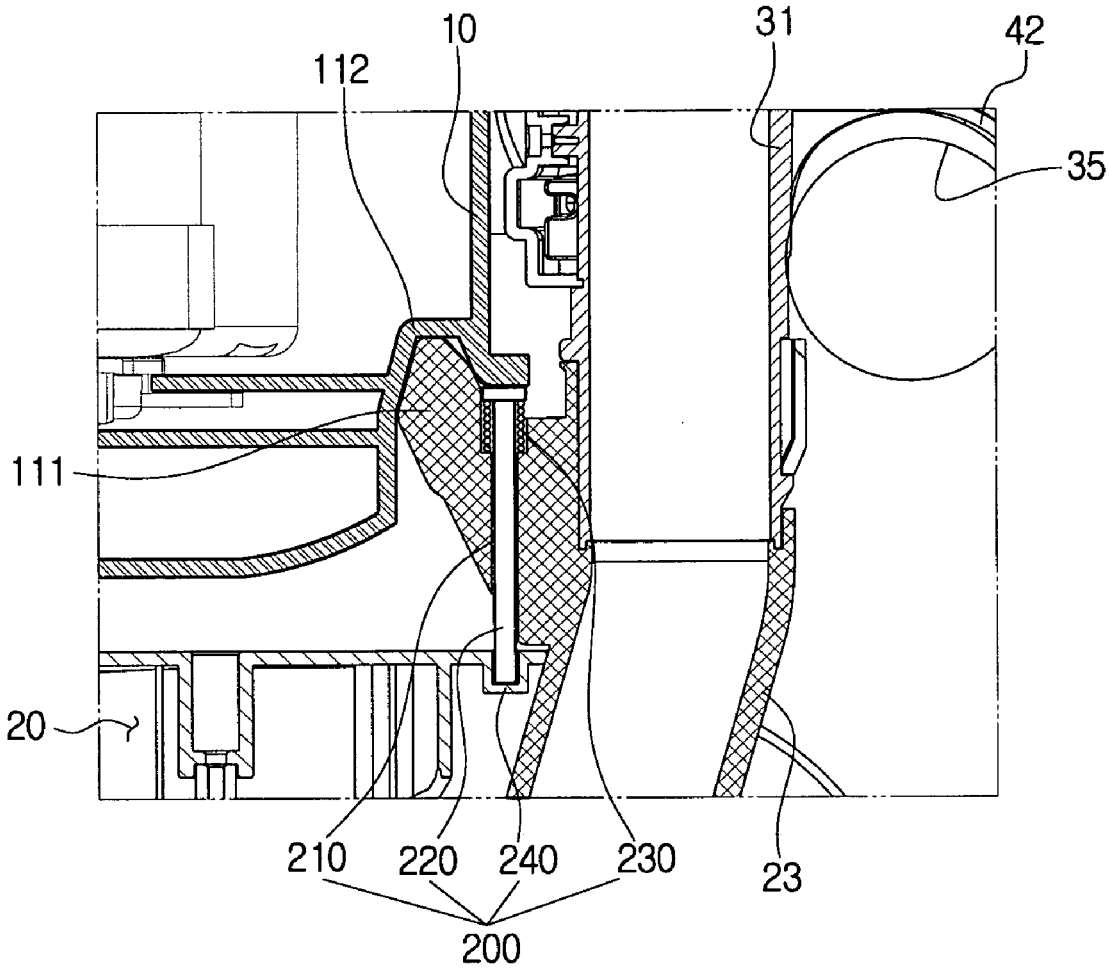

Referring to FIGS. 1 to 5, a vacuum cleaner includes a cleaner body 10, a brush assembly 1, a fixing unit 100, and a regulation unit 200 (see FIG. 10).

The cleaner body 10 has a vacuum source, e.g. a suction motor (not shown), and a dust collector (not shown) disposed therein. The suction motor generates a negative pressure to draw in dirt-entrained air through the brush assembly 1, and the dust collector filters and collects dirt from the drawn-in air.

Figure 3:
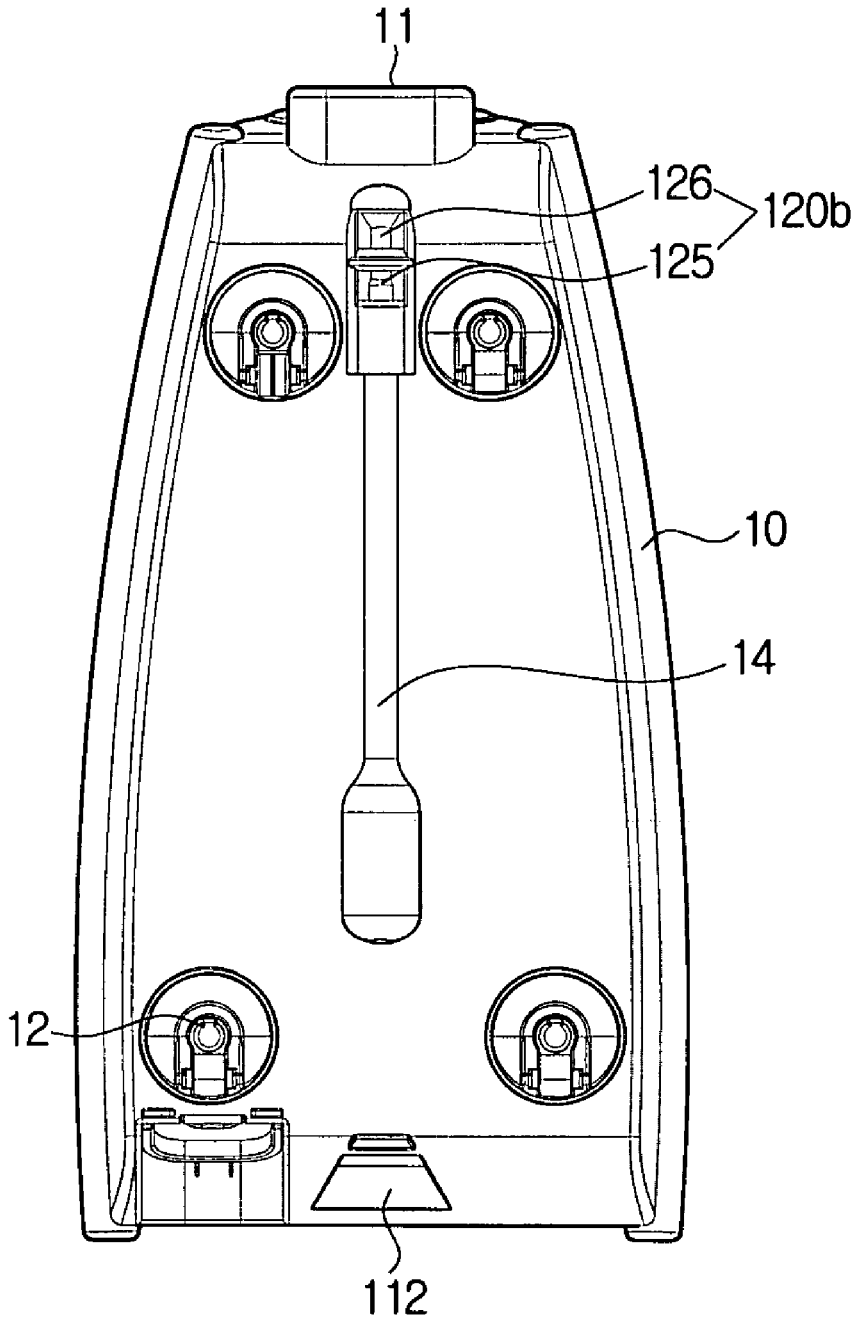
FIG. 3 is a rear portion of a cleaner body of the vacuum cleaner of FIGS. 1 and 2.
Figure 4:
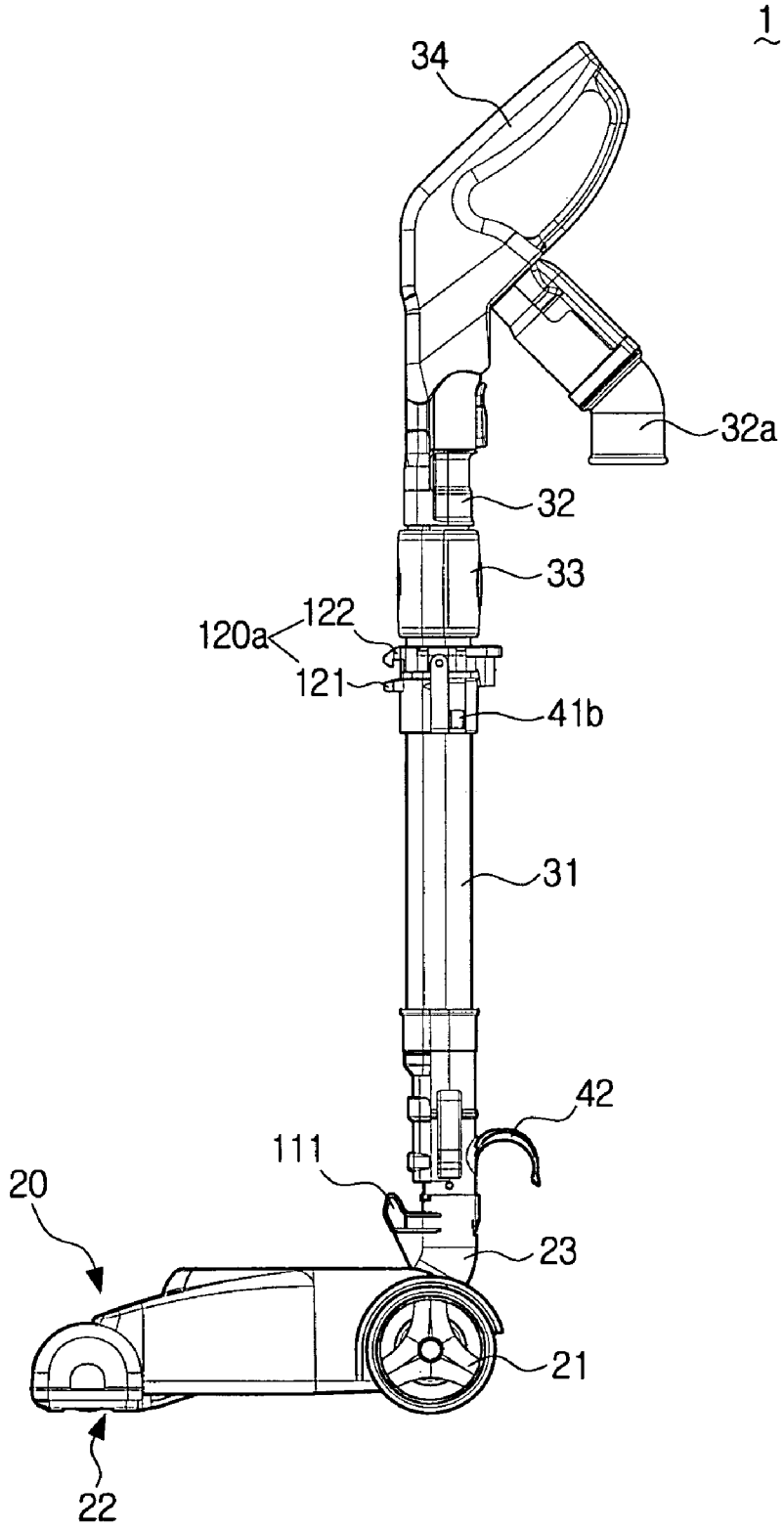
FIG. 4 is a side view illustrating an extension pipe assembly with one end connected to a suction brush.

FIG. 3 illustrates a rear portion of the cleaner body 10. The cleaner body 10 includes a connection portion 11 to which a flexible hose 35 is connected, a plurality of rolling wheels 12, a guide recess 14, and a hook receiving recess 112 and a grip portion 120*b* which constitute the fixing unit 100, which will be described below.

The brush assembly 1 includes a suction brush 20, a connector 23, and an extension pipe assembly 30.

The suction brush 20 draws in dirt-entrained air from a cleaning surface and includes a traveling member 21 and an agitator 22.

The traveling member 21 may include at least two wheels having a large diameter to allow the vacuum cleaner to travel smoothly when it is operated as an upright type vacuum cleaner.

The agitator 22 hits and scatters dirt on the cleaning surface, thereby improving a dirt suction efficiency, and is rotated by a driving force transmitted from a belt driving device (not shown) disposed inside the suction brush 20; that is, suction brush 20 functions as a driving unit for the agitator 22. The agitator 22 may be disposed at a front portion of the suction brush 20.

The connector 23 enables the suction brush 20 to fluidly communicate with the extension pipe assembly 30, which will be described in detail below, and has one end connected to a suction channel formed inside the suction brush and the other end connected to a channel formed inside the extension pipe assembly 30. The connector 23 guides the dirt-entrained air drawn in through the suction brush 20 to the channel formed inside the extension pipe assembly 30. The connector 23 can be vertically rotated.

The extension pipe assembly 30 includes a first extension pipe 31, a second extension pipe 32, an adjusting unit 33, and a manipulation handle 34. The cleaner body 10 is detachably mounted onto the first extension pipe 31 by the fixing unit 100 (see FIG. 5).

The first extension pipe 31 has one end to which the connector 23 of the suction brush 20 is connected and the other end to which the second extension pipe 32 is connected.

The second extension pipe 32 has one end connected to the first extension pipe 31 and has a hose connection portion 32*a* formed at the other end thereof to be connected to the cleaner body 10 via the flexible hose 35.

The adjusting unit 33 enables the second extension pipe 32 to be inserted into or withdrawn from the first extension pipe 31 according to a selection made by a user, and may be one of well-known extension pipe length adjusting devices.

The manipulation handle 34 is gripped by the user's hand and is designed to facilitate a cleaning operation. The user grips the manipulation handle 34 with his/her hand to perform a cleaning operation in both the cases that the vacuum cleaner is operated as an upright type vacuum cleaner and that it is operated as a canister type vacuum cleaner.

Figure 8:
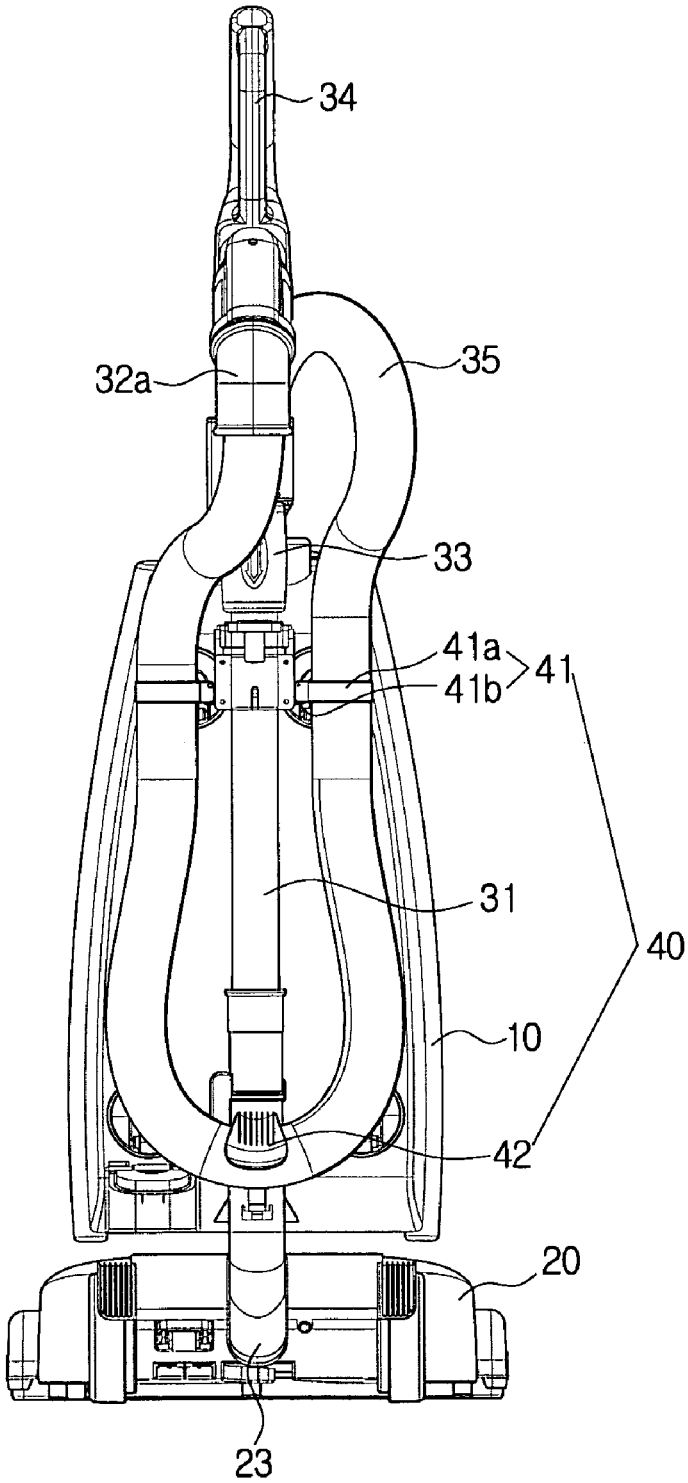
FIG. 8 is a rear side view illustrating the vacuum cleaner.

According to an exemplary embodiment of the present disclosure, the vacuum cleaner may further include a hose clamping device 40 for clamping the flexible hose 35 to a predetermined position, as shown in FIG. 8.

The hose clamping device 40 may include a first hose clamping unit 41 which clamps the flexible hose 35 at symmetrical positions of the extension pipe assembly 30 and a second hose clamping unit 42 which is disposed relatively lower than the first hose clamping unit 41.

The first hose clamping unit 41 is disposed at a predetermined position of the flexible hose 35, and includes two clamping rings 41*a* each having a hooking recess and hooking protrusions 41*b* disposed on the first extension pipe 31 to be press-fitted into the hooking recesses.

As shown in FIG. 8, the second hose clamping unit 42 may be disposed under the first extension pipe 31, for example, at a position adjacent to the connector 23. The second hose clamping unit 41 may have a radius corresponding to a diameter of the flexible hose 35 and have an opening formed at a certain area to enable the flexible hose 35 to be fitted thereto.

The cleaner body 10 of the vacuum cleaner constructed above is detachably mounted onto the extension pipe assembly 30 by the fixing unit 100 according to a necessity of the user.

Figure 5:
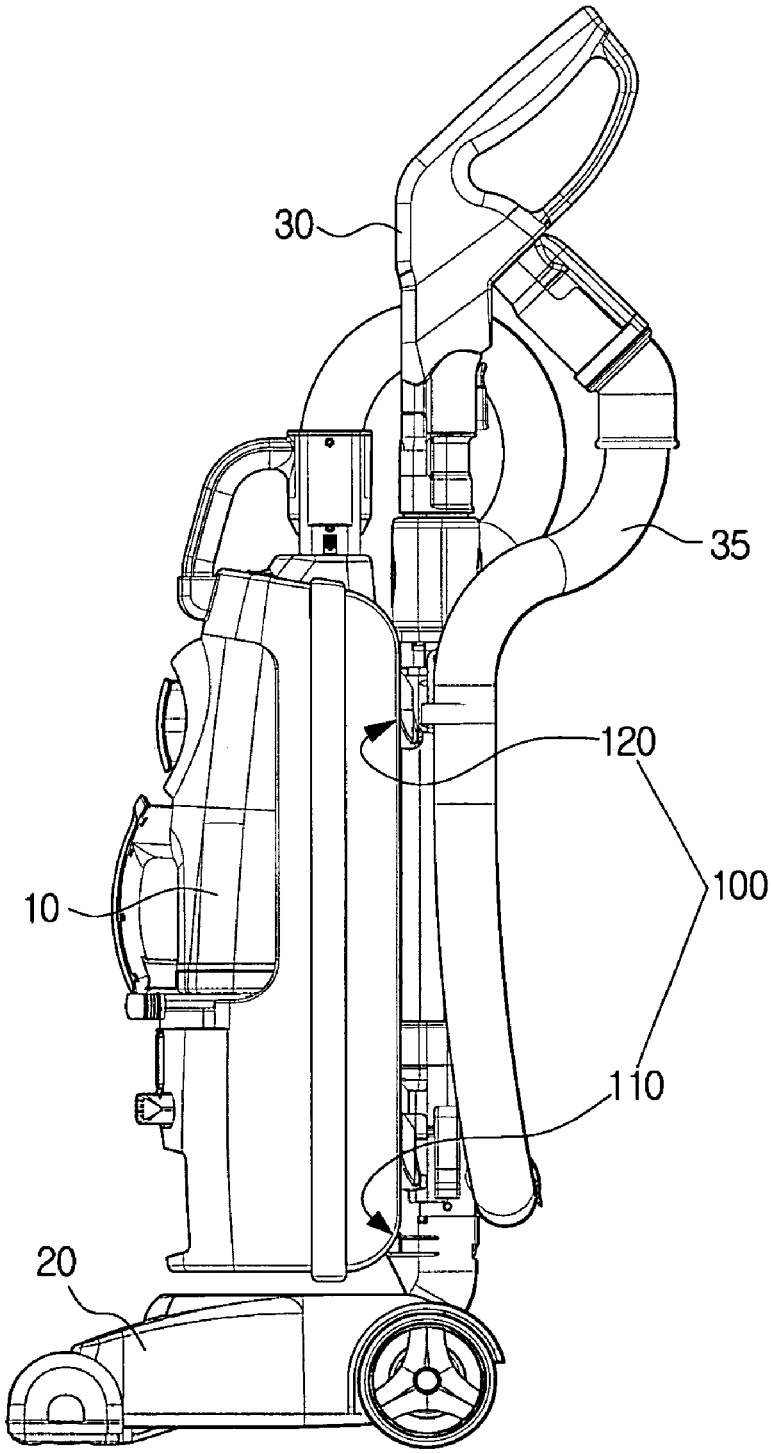
FIG. 5 is a side view illustrating the vacuum cleaner with the cleaner body being mounted onto the extension pipe assembly to be operated as an upright type vacuum cleaner.

As shown in FIG. 5, the fixing unit 100 includes a first locking member 110 for supporting a lower portion of the cleaner body 10 and a second locking member 120 for supporting the cleaner body 10 above the first locking member 110. The second locking member 120 is locked or released by the user.

Figure 6:
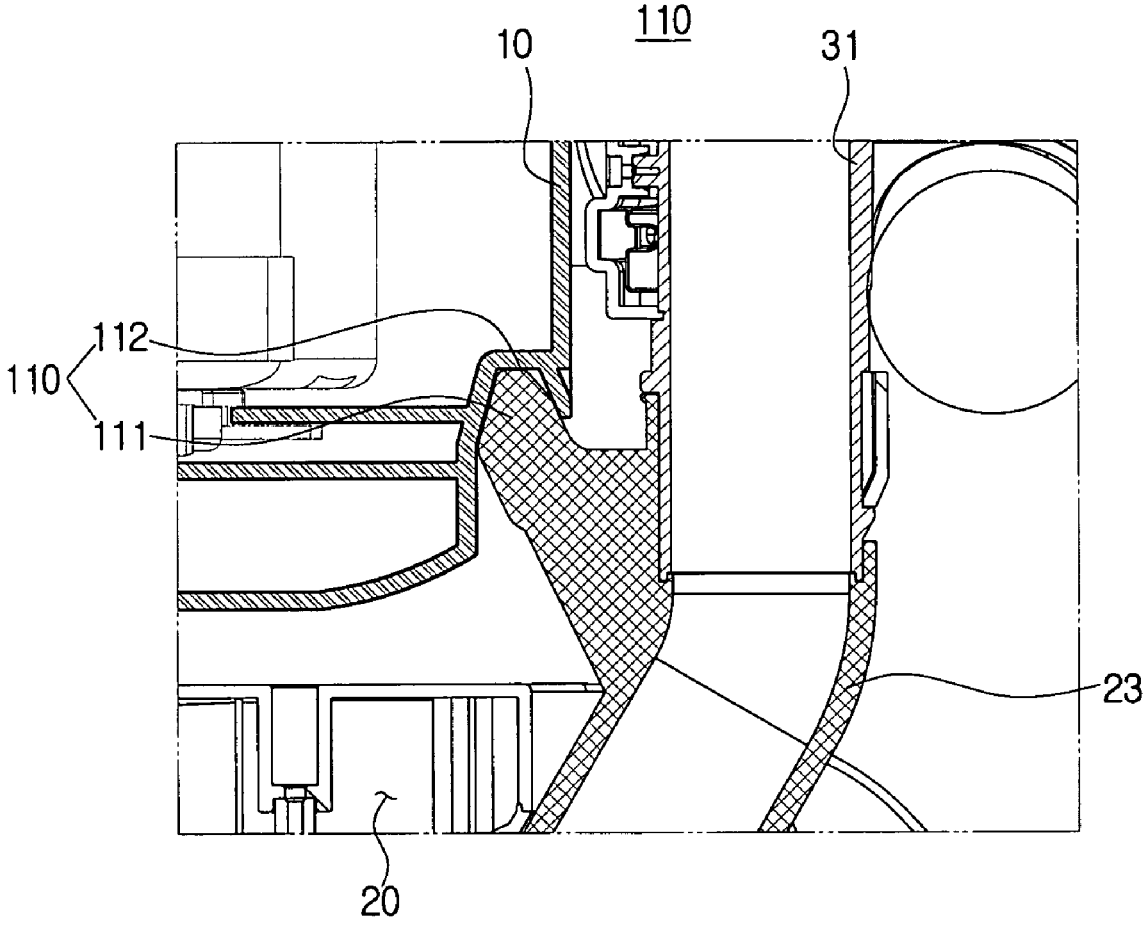
FIGS. 6 and 7 are side section views illustrating a fixing unit for detachably mounting the cleaner body onto the extension pipe assembly.

As shown in FIG. 6, the first locking member 110 includes a hook member 111 integrally formed with the connector 23 and a hook receiving recess 112 formed on the cleaner body 10, corresponding to the hook member 111.

The hook member 111 protrudes in the shape of "L" and the hook receiving recess 112 corresponds to the hook member 111 such that the hook member 111 advances upwardly and is hooked into the hook receiving recess 112 when the cleaner body 10 is mounted onto the extension pipe assembly 30 standing upright. The engagement state between the hook member 111 and the hook receiving recess 112 is maintained due to a load of the cleaner body 10.

Figure 7:
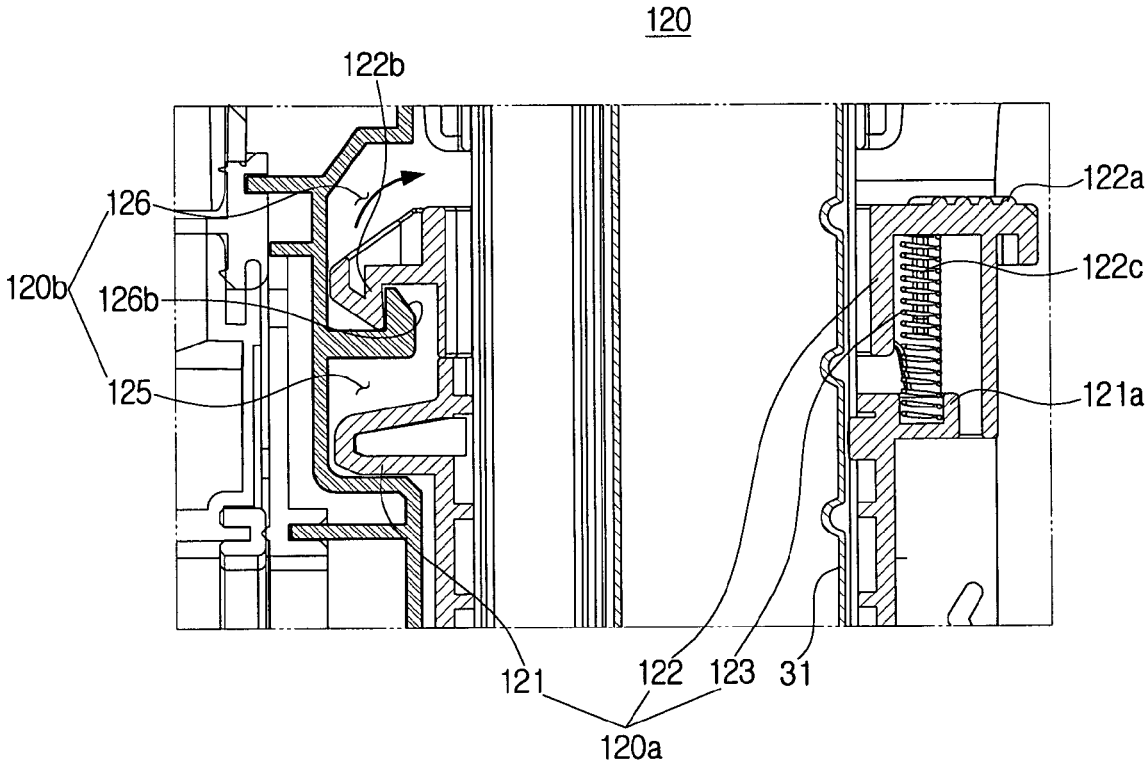

As shown in FIG. 7, the second locking member 120 includes a grip unit 120*a* and the grip portion 120*b*.

The grip unit 120*a* includes a support member 121, a grip member 122, and an elastic member 123.

The support member 121 is fixed to a predetermined position of the first extension pipe 31 of the extension pipe assembly 30 to dispersedly support a load applied from the cleaner body 10 along with the hook member 111.

The grip member 122 is hinged to the first extension pipe 31 away from an upper portion of the support member 121. The grip member 122 includes a push portion 122*a* pushed with a user's finger and a projection 122*b* formed opposite the push portion 122*a* to be selectively hooked into the grip portion 120*b*.

The push portion 122*a* is disposed on an opposite side of the first extension pipe 31 facing the cleaner body 10 such that it does not interfere with the cleaner body 10, which is locked to the extension pipe assembly 30, when the user pushes the push portion 122*a* with his/her finger.

The projection 122*b* has an inclined surface on a position facing the grip portion 120*b* to be slidably inserted into the grip portion 120*b*.

As shown in FIG. 7, the grip portion 120*b* includes a first grip recess 125 into which the support member 121 is inserted, and a second grip recess 126 into which the projection 122*b* of the grip member 122 is inserted. A protrusion 126*b* is formed in the second grip recess 126 to be brought into engagement with the projection 122*b*.

The elastic member 123 is disposed between the support member 121 and the grip member 122 and returns the grip member 122 to an initial position as the grip member 122 is released from a pressure applied by the user. In order to fix the position of the elastic member 123, an elastic member guide recess 121*a* is disposed in the support member 121 and a support protrusion 122*c* is formed on the grip member 122.

Figure 9:
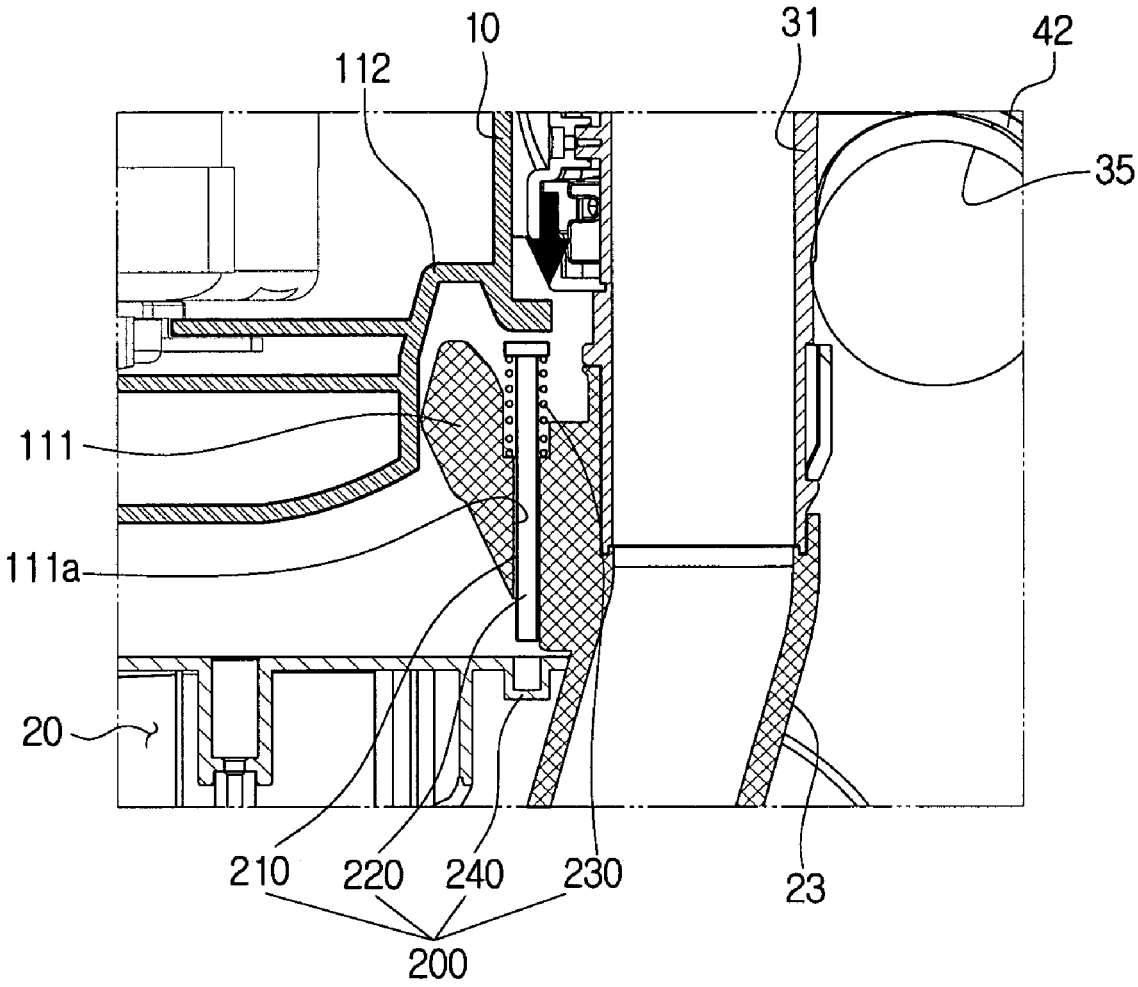
FIGS. 9 and 10 are side section views illustrating a regulation unit for restricting a horizontal rotation of a suction brush when a vacuum cleaner is operated as an upright type vacuum cleaner.

As shown in FIGS. 9 and 10, a vacuum cleaner further includes a regulation unit 200 for restricting a horizontal rotation of the suction brush 20 when the cleaner body 10 is mounted onto the extension pipe assembly 30.

The regulation unit 200 includes a key hole 210, a fixing key 220, an elastic member 230, and a key recess 240.

The key hole 210 is formed penetratingly through the hook member 111, and the fixing key 220 is inserted into the key hole 210 to be elastically supported by the elastic member 230 such that the fixing key 220 is selectively inserted into or withdrawn from the key recess 240 according to whether the cleaner body 10 is mounted onto or dismounted from the extension pipe assembly 30.

That is, as shown in FIG. 9, if the cleaner body 10 is not mounted onto the extension pipe assembly 30, the fixing key 220 is elastically supported by the elastic member 230 and thus does not interfere with the key recess 240. In this case, the suction brush 20 is free to rotate vertically and horizontally.

On the other hand, as shown in FIG. 10, if the cleaner body 10 is mounted onto the extension pipe assembly 30, an upper end of the fixing key 220 is pressed by the cleaner body 10 and the other end thereof is inserted into the key recess 240. In this case, the suction brush 20 is restricted from rotating horizontally due to the engagement of the fixing key 220 with the key recess 240.

Hereinafter, operation of the vacuum cleaner will be described.

The vacuum cleaner can be operated as an upright type vacuum cleaner or a canister type vacuum cleaner according to a selection made by the user.

That is, in order to clean a large area or a carpeted surface, the user converts the vacuum cleaner into an upright type vacuum cleaner by mounting the cleaner body 10 onto the extension pipe assembly 30 as shown in FIG. 1.

Figure 2:
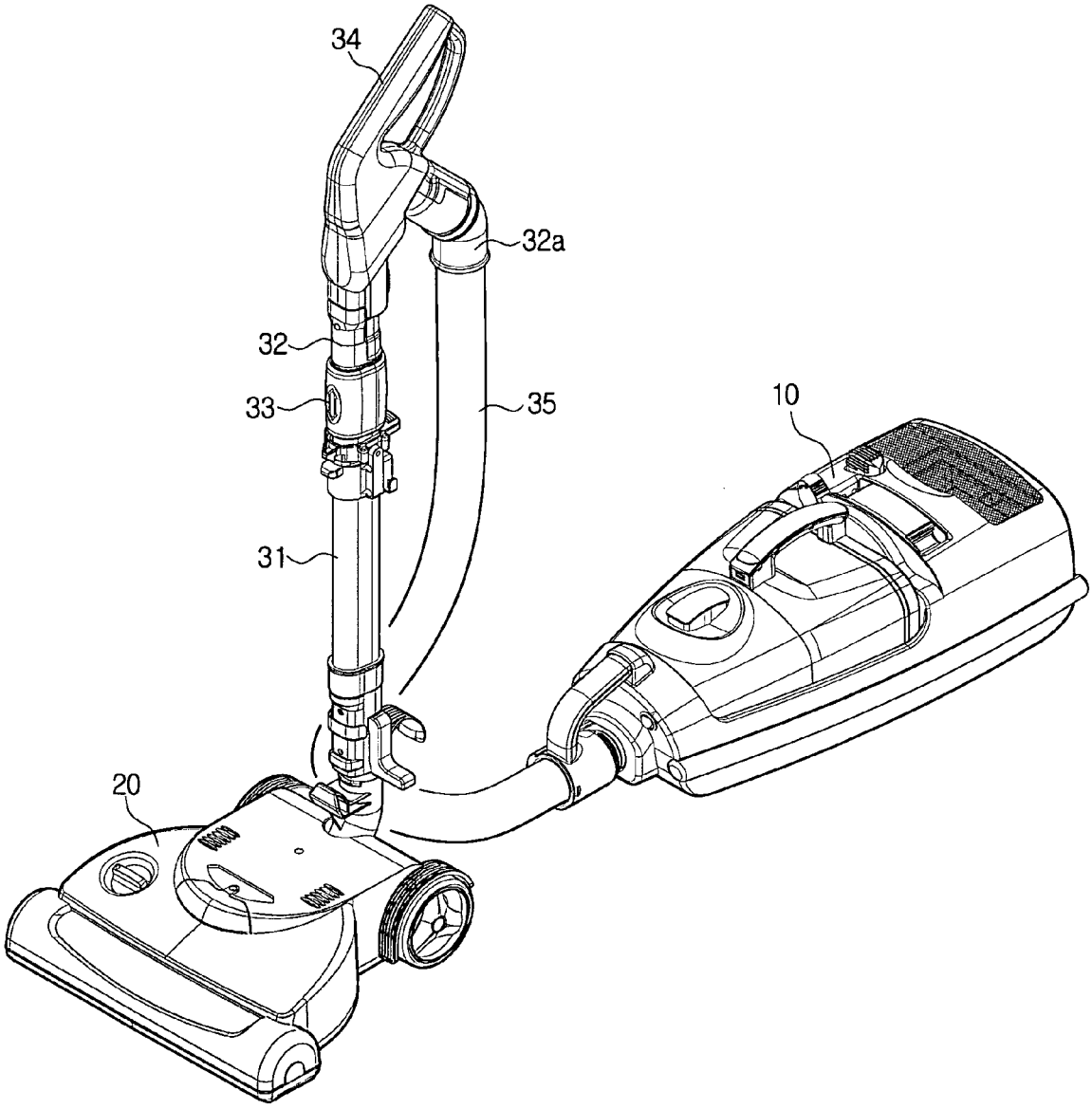
FIG. 2 is a perspective view illustrating the vacuum cleaner when it is operated as a canister type vacuum cleaner according to the exemplary embodiment of the present disclosure.

However, the user feels it inconvenient to use the upright type vacuum cleaner when cleaning a small area or an area with a doorsill. In this case, the user converts the vacuum cleaner into a canister type vacuum cleaner by dismounting the cleaner body 10 from the extension pipe assembly 30 as shown in FIG. 2.

The cleaner body 10 is dismounted from the extension pipe assembly 30 simply by pressing the push portion 122*a* of the grip member 122 of the second locking member 120 with the user's finger and then releasing the second locking member 120 from locking engagement.

That is, if the push portion 122*a* is pressed by the user, the grip member 122 turns in the arrow direction of FIG. 7, being released from the hinge engagement and being inserted into the second grip recess 126 such that the projection 122*b* is released from the engagement with the protrusion 126*b* and the locking is released.

Then, since the cleaner body 10 is released from the restriction of vertical movement, the hook member 111 and the hook receiving recess 112 of the first locking member 110 are released from the locking engagement with each other by lifting the cleaner body 10 upwardly such that the cleaner body 10 is dismounted from the extension pipe assembly 30.

If the cleaner body 10 is dismounted from the extension pipe assembly 30 through the above procedure, the vacuum cleaner can be operated as a canister type vacuum cleaner with the flexible hose 35 being unclamped from the hose clamping device 40. At this time, the cleaner body 10 can travel using the plurality of rolling wheels like a general canister type vacuum cleaner, and the suction brush 20 can be directly used as it is connected to the extension pipe assembly 30 without attaching an extra accessory brush to the cleaner body 10, which solves any inconvenience that may cause the user. The extension pipe assembly 30 is designed so that it can adjust the lengths of the first and the second extension pipes 31 and 32 according to a selection made by the user like a general canister type vacuum cleaner.

On the other hand, in order to use the vacuum cleaner as an upright type vacuum cleaner, the cleaner body 10 is mounted onto the extension pipe assembly 30 in the reverse order to the above-described procedure.

That is, if the cleaner body 10 is pushed toward the extension pipe assembly 30 with the hook member 111 being inserted into and held by the hook receiving recess 112 formed on a lower portion of the cleaner body 10, then the grip unit 120*a* is inserted into the grip portion 120*b* formed on the cleaner body 10. Then, the support member 121 is inserted into the first grip recess 125 to dispersedly support the load of the cleaner body 10 along with the hook member 111. The grip member 122 is inserted into the second grip recess 126, thereby restricting the vertical movement of the cleaner body 10. With this structure, the cleaner body 10 is not released from the locking engagement with the extension pipe assembly 30 even if the user lifts only the cleaner body 10 or if the vacuum cleaner falls due to a careless user, which may cause the first locking member 110 to move in a unlocking direction.

Also, as described above, after the cleaner body 10 is locked into the extension pipe assembly 30, it is preferable to fix the flexible hose 35 to have a "U" shape using the hose clamping device 40 as shown in FIG. 8. More specifically, the flexible hose 35 is hung at the symmetrical positions of the first extension pipe 31 using a pair of first hose clamping units 41 and the flexible hose 45 is also fixed to a lower portion of the first extension pipe 31 using the second hose clamping unit 42. If the flexible hose 35 is arranged in this way, the flexible hose 35 is prevented from being dragged on the floor when the vacuum cleaner is operated as an upright type vacuum cleaner.

The foregoing description is merely exemplary and is not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A vacuum cleaner comprising:

a brush assembly that travels along a cleaning surface and draws in dirt-entrained air therethrough;

a cleaner body that is connected to the brush assembly via an extension pipe assembly and has a dust collector;

a fixing unit that detachably mounts the cleaner body onto the brush assembly such that the vacuum cleaner is used as an upright type vacuum cleaner and dismounts the cleaner body from the brush assembly such that the vacuum cleaner is used as a canister type vacuum cleaner; and a regulation unit that restricts a horizontal rotation of the brush assembly if the cleaner body is mounted onto the brush assembly, wherein the fixing unit comprises:

a first locking member that supports a lower portion of the cleaner body; and a second locking member that supports an upper portion of the cleaner body and is locked and released by a user, wherein the second locking member comprises:

a grip unit that is disposed on the first extension pipe; and a grip portion that is disposed on a position of the cleaner body corresponding to the grip unit, and wherein the grip unit comprises:

a support member that is fixed to a position of the first extension pipe to support a load applied from the cleaner body;

a grip member that is hinged onto a position away from an upper portion of the support member; and an elastic member that is disposed between the support member and the grip member.

2. The vacuum cleaner as claimed in claim 1, wherein the brush assembly comprises:

a suction brush; and a connector that is connected to the suction brush and is rotated in a vertical direction, wherein the extension pipe assembly is connected to the connector.

3. The vacuum cleaner as claimed in claim 2, wherein the extension pipe assembly comprises:

a first extension pipe that is connected to the connector;

a second extension pipe that has one end connected to the first extension pipe and the other end connected to the cleaner body via a flexible hose, the second extension pipe being inserted into the first extension pipe;

an adjusting unit that adjusts lengths of the first and the second extension pipes; and a manipulation handle that is disposed on the second extension pipe.

4. The vacuum cleaner as claimed in claim 1, wherein the first locking member comprises:

a hook member that is integrally formed with the connector; and a hook receiving recess that is formed on a position of the cleaner body corresponding to the hook member.

5. The vacuum cleaner as claimed in claim 4, wherein the hook member is L-shaped.

6. The vacuum cleaner as claimed in claim 1, wherein the grip member comprises:

a push portion that is pushed by a user with his/her finger;

a projection which is disposed opposite the push portion and selectively hooked onto the grip portion; and a support protrusion that supports one end of the elastic member.

7. The vacuum cleaner as claimed in claim 6, wherein the grip portion comprises:

a first grip recess into which the support member is inserted; and a second grip recess into which the projection of the grip member is inserted.

8. The vacuum cleaner as claimed in claim 3, further comprising a hose clamping device that clamps the flexible hose to a predetermined position.

9. The vacuum cleaner as claimed in claim 8, wherein the hose clamping device comprises:

a first hose clamping unit that clamps the flexible hose at symmetric positions of the first extension pipe; and a second hose clamping unit that is disposed relatively lower than the first clamping unit.

10. The vacuum cleaner as claimed in claim 9, wherein the first hose clamping unit comprises:

two clamping rings that are disposed at predetermined positions of the flexible hose and have hooking recesses; and hooking protrusions that are disposed on the first extension pipe and press-fitted into the hooking recesses.

11. The vacuum cleaner as claimed in claim 9, wherein the second hose clamping unit has an opening that is disposed on the first extension pipe and has a radius corresponding to a diameter of the flexible hose to allow the flexible hose to be held therein.

12. The vacuum cleaner as claimed in claim 5, wherein the regulation unit comprises:

a key hole that is formed penetratingly through the hook member;

a fixing key that is ascendable and descendable in the key hole;

an elastic member that elastically supports the fixing key; and a key recess that is disposed opposite the fixing key of the suction brush, wherein, if the cleaner body is mounted onto the brush assembly, the fixing key is pressed by the cleaner body and thus is inserted into the key recess, and if the cleaner body is dismounted from the brush assembly, the fixing key is returned to an original position.

13. The vacuum cleaner as claimed in claim 2, wherein the suction brush comprises:

an agitator that scatters dirt drawn in from a cleaning surface; and a driving unit that supplies a driving force to rotate the agitator.

14. The vacuum cleaner as claimed in claim 13, wherein the suction brush has the agitator disposed at a front portion thereof and a traveling member disposed at a rear portion of the suction brush.

15. A vacuum cleaner comprising:

a brush assembly that travels along a cleaning surface and draws in dirt-entrained air therethrough;

a cleaner body that is connected to the brush assembly and has a dust collector;

a fixing unit that detachably mounts the cleaner body onto the brush assembly such that the vacuum cleaner is used as an upright type vacuum cleaner and dismounts the cleaner body from the brush assembly such that the vacuum cleaner is used as a canister type vacuum cleaner;

a regulation unit that restricts a horizontal rotation of the brush assembly if the cleaner body is mounted onto the brush assembly, wherein the brush assembly comprises:

a suction brush;

a connector that is connected to the suction brush and is rotated in a vertical direction; and an extension pipe assembly that is connected to the connector, wherein the extension pipe assembly comprises:

a first extension pipe that is connected to the connector;

a second extension pipe that has one end connected to the first extension pipe and the other end connected to the cleaner body via a flexible hose, the second extension pipe being inserted into the first extension pipe;

an adjusting unit that adjusts lengths of the first and the second extension pipes; and a manipulation handle that is disposed on the second extension pipe; and a hose clamping device that clamps the flexible hose to a predetermined position, wherein the hose clamping device comprises:

a first hose clamping unit that clamps the flexible hose at symmetric positions of the first extension pipe; and a second hose clamping unit that is disposed relatively lower than the first clamping unit.

16. The vacuum cleaner as claimed in claim 15, wherein the first hose clamping unit comprises:

two clamping rings that are disposed at predetermined positions of the flexible hose and have hooking recesses; and hooking protrusions that are disposed on the first extension pipe and press-fitted into the hooking recesses.

17. The vacuum cleaner as claimed in claim 15, wherein the second hose clamping unit has an opening that is disposed on the first extension pipe and has a radius corresponding to a diameter of the flexible hose to allow the flexible hose to be held therein.

18. A vacuum cleaner comprising:

a brush assembly that travels along a cleaning surface and draws in dirt-entrained air therethrough;

a cleaner body that is connected to the brush assembly and has a dust collector;

a fixing unit that detachably mounts the cleaner body onto the brush assembly such that the vacuum cleaner is used as an upright type vacuum cleaner and dismounts the cleaner body from the brush assembly such that the vacuum cleaner is used as a canister type vacuum cleaner; and a regulation unit that restricts a horizontal rotation of the brush assembly if the cleaner body is mounted onto the brush assembly, wherein the brush assembly comprises:

a suction brush;

a connector that is connected to the suction brush and is rotated in a vertical direction; and an extension pipe assembly that is connected to the connector, wherein the extension pipe assembly comprises:

a first extension pipe that is connected to the connector;

a second extension pipe that has one end connected to the first extension pipe and the other end connected to the cleaner body via a flexible hose, the second extension pipe being inserted into the first extension pipe;

an adjusting unit that adjusts lengths of the first and the second extension pipes; and a manipulation handle that is disposed on the second extension pipe, wherein the fixing unit comprises:

a first locking member that supports a lower portion of the cleaner body; and a second locking member that supports an upper portion of the cleaner body and is locked and released by a user, wherein the first locking member comprises:

a hook member that is integrally formed with the connector; and a hook receiving recess that is formed on a position of the cleaner body corresponding to the hook member, wherein the hook member is L-shaped, and wherein the regulation unit comprises:

a key hole that is formed penetratingly through the hook member;

a fixing key that is ascendable and descendable in the key hole;

an elastic member that elastically supports the fixing key; and a key recess that is disposed opposite the fixing key of the suction brush, wherein, if the cleaner body is mounted onto the brush assembly, the fixing key is pressed by the cleaner body and thus is inserted into the key recess, and if the cleaner body is dismounted from the brush assembly, the fixing key is returned to an original position.

* * * * *